US005398426A

United States Patent [19]

Connor

[11] Patent Number: 5,398,426

[45] Date of Patent: Mar. 21, 1995

[54] PROCESS AND APPARATUS FOR DESICCATION

[75] Inventor: John T. Connor, Phoenixville, Pa.

[73] Assignee: Societe' De Gestion Et De Diffusion North America, Inc., Phoenixville, Pa.

[21] Appl. No.: 174,821

[22] Filed: Dec. 29, 1993

[51] Int. Cl.[6] ..... F26B 5/06

[52] U.S. Cl. ..... 34/289; 62/55.5; 34/92

[58] Field of Search ..... 62/18, 55.5; 34/284, 34/287, 289, 297, 301, 405–408, 472–473, 92

[56] References Cited

U.S. PATENT DOCUMENTS

| | | | |
|---|---|---|---|
| 2,292,447 | 8/1942 | Irwin, Jr. | 34/289 |
| 3,178,829 | 4/1965 | Cox | 34/289 |
| 3,199,217 | 8/1965 | Oldenkamp et al. | 34/287 X |
| 3,262,212 | 7/1966 | De Buhr | 34/284 |
| 3,263,335 | 8/1966 | Kan | 34/284 |
| 3,323,225 | 6/1967 | Achucarro | 34/289 X |
| 3,384,978 | 5/1968 | Cox | 34/92 |
| 3,448,527 | 6/1969 | Hernandez, Jr. | 34/289 |
| 3,466,756 | 9/1969 | Tooby | 34/284 |
| 3,487,554 | 1/1970 | Tooby | 34/92 |
| 3,574,950 | 4/1971 | Dantoni | 62/55.5 X |
| 3,635,039 | 1/1972 | Power et al. | 62/55.5 |
| 3,716,382 | 2/1973 | Chandasekaran et al. | 34/287 |
| 4,182,749 | 1/1980 | Green et al. | 62/55.5 X |
| 4,479,927 | 10/1984 | Gelernt | 62/55.5 X |
| 4,597,188 | 7/1986 | Trappler | 34/284 |
| 4,612,200 | 9/1986 | Sato | 34/284 X |
| 5,131,168 | 7/1992 | Rilke et al. | 34/284 |
| 5,199,187 | 4/1993 | Sutherland | 34/92 |
| 5,303,558 | 4/1994 | Caton et al. | 62/55.5 |

FOREIGN PATENT DOCUMENTS

| | | | |
|---|---|---|---|
| 560632 | 9/1993 | European Pat. Off. | 34/284 |
| 2461213 | 1/1981 | France . | |
| 2025999 | 12/1970 | Germany . | |
| 8074103 | 5/1983 | Japan | 34/297 |
| 2126089 | 5/1990 | Japan | 34/289 |
| 2157587 | 6/1990 | Japan | 34/297 |
| 2169984 | 6/1990 | Japan | 34/289 |
| 387547 | 5/1965 | Switzerland . | |
| 2120370 | 11/1983 | United Kingdom | 34/297 |
| 606058 | 5/1978 | U.S.S.R. | 34/297 |

OTHER PUBLICATIONS

A. Gac, G. Letang, M. Pottier; "Etude du Piegeage de la Vapeur d'eau en Lyophillisation", Bul. L'Inst Int. de Froid, vol. 4, No. 3, 1974. pp. 149–157.

Derwent Abstracts, Section CH, Week 8327, Derwent Pub. Ltd., London, GB, Class J, AN 83-704268, SU-A-953,396. Aug. 25, 1982.

*Primary Examiner*—Christopher Kilner

*Attorney, Agent, or Firm*—Brian J. Laurenzo; Kent A. Herink; Brett J. Trout

[57] ABSTRACT

The invention relates to a process and apparatus for desiccation in which the exterior walls of the apparatus are heated and cooled in synchronization with the interior of the apparatus to avoid temperature gradients and inconsistent desiccation of material placed within the apparatus. The apparatus wall temperature regulating means also allows for more accurate sterilization of the apparatus after the desiccation process has been completed.

16 Claims, 6 Drawing Sheets

PROCESS AND APPARATUS FOR DESICCATION

BACKGROUND OF THE INVENTION

The present invention relates generally to desiccation of a material, and, more particularly to a process and apparatus for accurately and repeatably desiccating material which requires strict temperature control during the desiccation process.

Desiccation techniques and apparatuses are well-known in the art and typically consist of a desiccation chamber and a trap chamber. The desiccation chamber is often provided with racks which support the material to be desiccated. The racks themselves are often provided with tubes which carry a heat-carrying fluid to heat, or to draw heat away from, the material as appropriate. The trap chamber is provided with a trap which is cooled during the desiccation process. The chambers are typically connected by means of a conduit through which water vapor passes from the desiccation chamber to the trap chamber during the desiccation process.

To begin desiccation, the material is placed upon the racks and brought to a very low temperature, typically on the order −45° C. The trap is brought to a similarly low temperature. After the material has adequately cooled throughout its interior, the temperature of the racks is raised to a temperature just below the eutectic of the material. The pressure within both the desiccation chamber and the trap chamber is reduced to a few pascals. Under this low pressure, moisture within the material sublimes, with the vapor moving toward the colder trap, which captures and retains the moisture. After most of the moisture has been removed from the material, the racks are heated to remove the last traces of water bound within the material. The material is then adequately desiccated and ready for use.

One draw-back with prior art desiccation apparatuses and techniques is the temperature gradient within the desiccation chamber. Although the temperature of the racks are accurately controlled with the heat-carrying fluid, the walls of the desiccation chamber remain significantly warmer than the racks. Due to this temperature gradient, the walls of the desiccation chamber tend to radiate heat toward the edges of the racks. This radiated heat warms the material placed at the edges of the rack more than material placed at the center of the racks, throughout the cooling process. Similarly, as the racks are heated above room temperature, the walls of the desiccation chamber remain cooler than the racks, absorbing heat more readily from the edges of the racks than from the center of the racks. Both of these factors co-act to create inconsistent desiccation between material at the edges of the racks and material at the centers of the racks. While such temperature variances may be acceptable for some products, products such as pharmaceuticals require highly specific and consistent desiccation temperatures to create materials within desired specifications.

Another problem associated with prior art desiccation apparatuses and methods involves sterilization of the apparatuses. Sterilization typically involves adding a sterilizing material such as hydrogen peroxide to both the desiccation chamber and the trap chamber and elevating the temperatures within both chambers to aid in the sterilization process. The aforementioned temperature gradient between the interior of the chambers and the walls of the chambers leads to inconsistent sterilization. This temperature variance often leads to lengthy sterilization processes required to assure every portion of both chambers has reached an adequate temperature for a sufficient length of time.

The difficulties encountered in the prior art discussed hereinabove are substantially eliminated by the present invention.

SUMMARY

Accordingly it is an object of the present invention to provide a process for desiccating a material, wherein all material to be desiccated is cooled to substantially the same temperature.

A further object of the present invention is to provide a process for desiccating a material, wherein all the material to be desiccated is heated to the same temperature.

Another object of the present invention is to provide a process for desiccating material, wherein sterilization of the desiccation apparatus is achieved with substantially the entire interior of the apparatus being brought to a consistent temperature.

Another object of the present invention is to provide a desiccation apparatus for desiccating material, wherein the apparatus is capable of cooling all material which is to be desiccated to a consistent temperature.

Another object of the present invention is to provide a desiccation apparatus for desiccating material, wherein the apparatus is capable of heating all material which is to be desiccated to a consistent temperature.

One other object of the present invention is to provide a desiccation apparatus for desiccating material, wherein the apparatus is capable of maintaining a consistent temperature throughout the entire interior of the apparatus during sterilization of the apparatus.

These and other objects of the present invention will become apparent upon reference to the following specification, drawings, and claims.

By the present invention it is proposed to overcome the difficulties heretofore. To this end, a desiccation apparatus for removing water from material is provided with a desiccation chamber having walls. A rack is operably provided within the desiccation chamber and is capable of supporting the material to be desiccated. A trap chamber having walls is operably connected to the desiccation chamber, with means for allowing passage of water vapor from the desiccation chamber to the trap chamber. A trap is operably provided within the trap chamber. Means are operably connected to the rack and trap for regulating their temperatures. Means are also operably connected to the walls of the desiccation chamber for regulating the temperature of the walls.

Preferably, sets of heat-carrying fluid circulating tubes traverse the walls of the desiccation chamber and the walls of the trap chamber. The heat-carrying liquid provided within the tubes is preferably a silicone refrigerating liquid capable of being brought to a temperature of at least 122° C. while still remaining at a pressure of around 1,000 pascals.

DETAILED DESCRIPTION OF THE INVENTION

Figure 1:
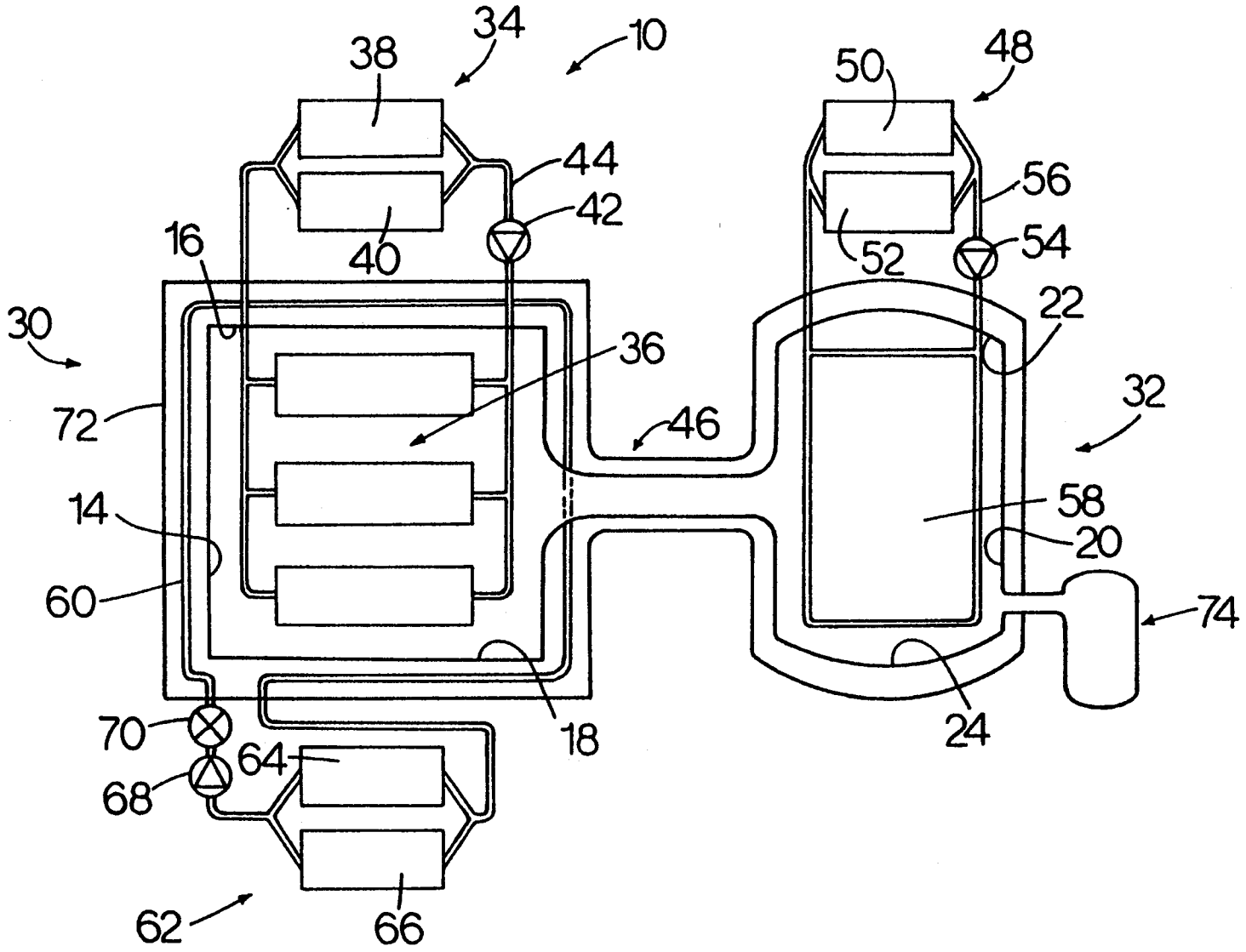
FIG. 1 is a schematic of the desiccation apparatus of the present invention showing an autonomous circulation system surrounding the desiccation chamber of the present invention.
Figure 5:
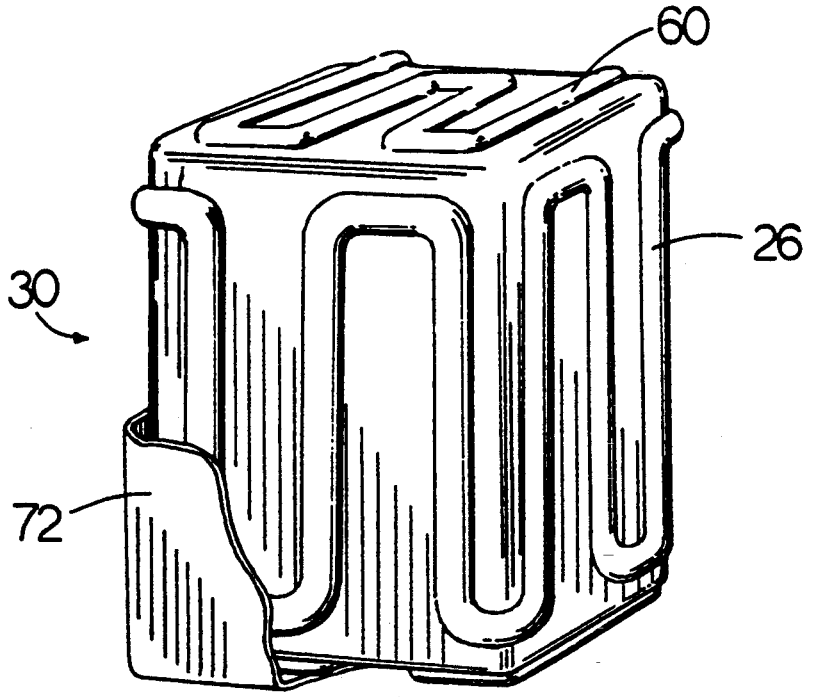
FIG. 5 is a perspective view in partial cutaway of the desiccation chamber, showing the walls of the desiccation chamber traversed with a primary set of heat-carrying fluid circulating tubes.
Figure 6:
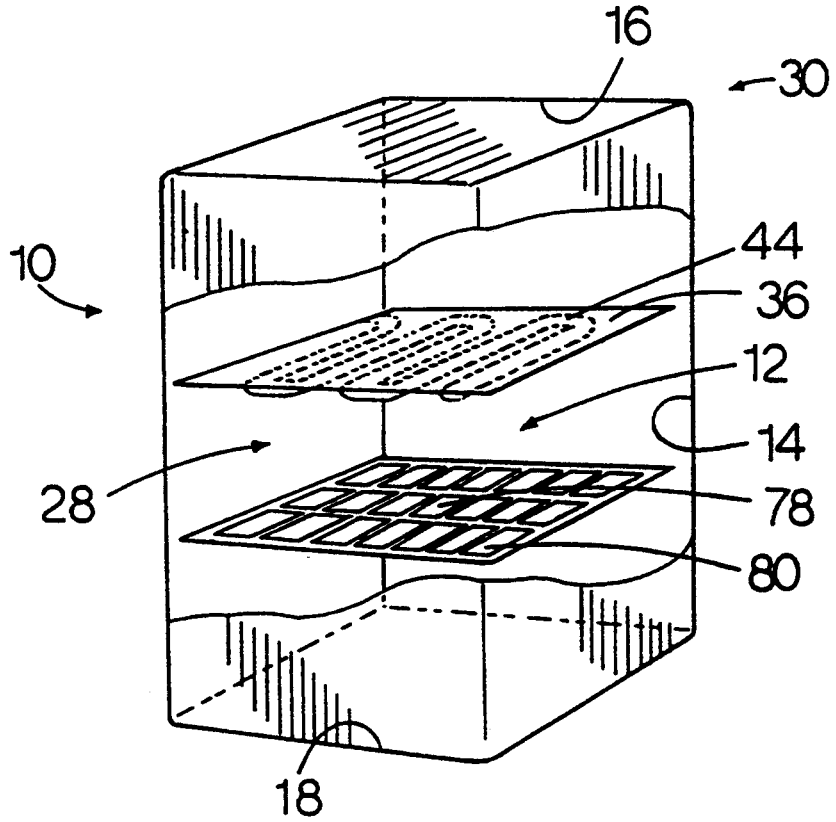
FIG. 6 is a perspective view in partial cut-away of the desiccation chamber of the present invention showing a second set of heat-carrying fluid circulating tubes traversing a first rack, and material distributed across a second rack.

In the Figures, a process and apparatus 10 for removing moisture from a material 12 (FIGS. 1 and 6). The apparatus 10 is provided with a desiccation chamber 30 and a trap chamber 32. The desiccation chamber 30 is provided with walls 14–18 which are surrounded with a series of heat-carrying fluid circulating tubes 26 (FIG. 5). The heat-carrying fluid circulating tubes 26 maintain the walls 14–18 of the desiccation chamber 30 at substantially the same temperature as an interior 28 of the desiccation chamber 30, throughout the desiccation process (FIGS. 5 and 6).

There is shown in FIG. 1 the desiccation apparatus 10 having the desiccation chamber 30 and the trap chamber 32. The desiccation chamber 30 is provided with a primary temperature regulating circuit 34. A set of racks 36 are provided within the desiccation chamber 30 to support and transfer heat into and away from the material 12 to be desiccated. The primary temperature regulating circuit 34 runs into the racks 36 and is provided with a heat production unit 38, a cold production unit 40, and a circulation pump 42. The primary temperature regulating circuit 34 is preferably provided with an autonomous set of heat-carrying fluid circulating tubes 44 passing from the heat and cold production units 38 and 40 to the racks 36 and back again.

As shown in FIG. 6, the tubes 44 preferably traverse the racks 36 in a zig-zag orientation so as to evenly distribute heat throughout the racks 36. It is preferable to use a single fluid to draw away heat for desiccation and to add heat for sterilization of the apparatus 10 (FIG. 1). Accordingly, silicone fluids are preferred as having shown very high performance at temperature ranges encountered in the desiccation process. Particularly suitable fluids are obtained from the family of the polymers of dimethyl siloxane. Due, however, to the viscosity of these polymers at low temperatures, all of the heat-carrying fluid circulating tubes 26 are provided with large cross-sections, preferably on the order of 10 centimeter diameters.

The trap chamber 32 is connected to the desiccation chamber 30 by means of a conduit 46 (FIG. 1). The trap chamber 32 is provided with a trap temperature regulating circuit 48. Like the rack temperature regulating circuit 34, the trap temperature regulating circuit 48 is provided with a heat production unit 50, a cold production unit 52, and a circulation pump 54. The trap temperature regulating circuit 48 is also provided with a set of heat-carrying fluid circulating tubes 56. A trap 58 is provided within the trap chamber 32 and is traversed by the heat-carrying fluid circulating tubes 56 of the trap temperature regulating circuit 48.

The walls 14–18 of the desiccation chamber 30 and walls 20–24 provided on the trap chamber 32 are preferably air-tight to prevent leakage of air into the apparatus 10 during the low-pressures encountered in the desiccation process (FIG. 1). Provided within the walls 14–18 of the desiccation chamber 30 are heat-carrying fluid circulating tubes 60 which are a part of a desiccation wall temperature regulating circuit 62 (FIG. 5). Like the aforementioned temperature regulating circuits 34 and 48, the desiccation wall temperature regulating circuit 62 has a heat production unit 64, a cold production unit 66, and a circulation pump 68 (FIG. 1). A shut-off valve 70 is also provided on the heat-carrying fluid circulating tubes 60 to stop the flow of fluid through the desiccation wall temperature regulating circuit 62 if it is desired to desiccate a product without the use of the desiccation wall temperature regulating circuit 62. Preferably the walls 14–18 of the desiccation chamber 30 are covered with all insulative material 72 to prevent the loss of heat from either the walls 14–18 of the desiccation chamber 30 or the heat-carrying fluid circulating tube 60 to the exterior atmosphere. A vacuum pump 74 is preferably connected to the trap chamber 32 to allow both the desiccation chamber 30 and the trap chamber 32 to experience a reduction in pressure sufficient to desiccate the material 12 added to the apparatus 10 (FIGS. 1 and 6).

To begin the desiccation process, material 12 is evenly distributed on the racks 36 of the desiccation chamber 30 and the apparatus 10 is sealed (FIG. 6). The circulation pump 42 of the rack temperature regulating circuit 34 pumps cold fluid through the racks 36 until the racks 36 and the material 12 have reached a predetermined low-end temperature of approximately −50° C. (FIGS. 1 and 6). It should be noted that the optimal temperatures vary depending on the particular material 12 being desiccated. As the racks are being cooled, the circulation pump 54 of the trap temperature regulating circuit 48 pumps cold fluid into the trap 58 until the trap 58 has reached a temperature of approximately −70° C. (FIG. 1). The shut-off valve 70 of the desiccation wall temperature regulating circuit 62 is opened to allow the circulation pump 68 to move cold fluid around the walls 14–18 of the desiccation chamber 30. The desiccation wall temperature regulating circuit 62 cools the walls 14–18 of the desiccation chamber 30 at substantially the same rate at which the racks 36 are being cooled.

Once the racks 36 have been maintained at a predetermined low-end temperature for a sufficient time to bring the material 12 to this low-end temperature, the vacuum pump 74 lowers the pressure within the apparatus to the optimal desiccation pressure for the particular material 12 being desiccated (FIGS. 1 and 6). The rack temperature regulating circuit 34 heats the racks 36 to bring the material 12 to a temperature just below the eutectic of the material 12. Similarly, the desiccation wall temperature regulating circuit 62 raises the temperature of the walls 14–18 of the desiccation chamber 30 at the same rate as the racks 36 are being heated.

As the material 12 is being desiccated, the material 12 cools from the escaping moisture (FIGS. 1 and 6). Accordingly, the rack temperature regulating circuit 34 provides heat to the racks 36 to counteract this cooling effect. The walls 14–18 of the desiccation chamber 30 are monitored and maintained at substantially the same temperature as the racks 36. As the material 12 is typically not in direct contact with the walls 14–18 of the desiccation chamber 30, it may not be necessary to add heat to the the walls 14–18 of the desiccation chamber 30 during this portion of the desiccation process. The moisture subliming from the material 12 passes through the conduit 46 and migrates toward the trap 58 which is maintained at a temperature below that of the racks. After a period of time, the amount of moisture subliming from the material 12 decreases substantially. Although some moisture typically remains within the material 12, it is often required to raise the temperature of the racks 36, as shown graphically by the solid line in FIG. 7, to remove this last bit of "bound" moisture. As the racks 36 are heated to remove this bound moisture, the desiccation wall temperature regulating circuit 62 raises the temperature of the walls 14–18 of the desiccation chamber 30, along with the racks 36 (FIG. 1). The racks 36 and walls 14–18 of the desiccation chamber 30 are then cooled and the desiccated material 12 is removed (FIGS. 1 and 6).

Figure 2:
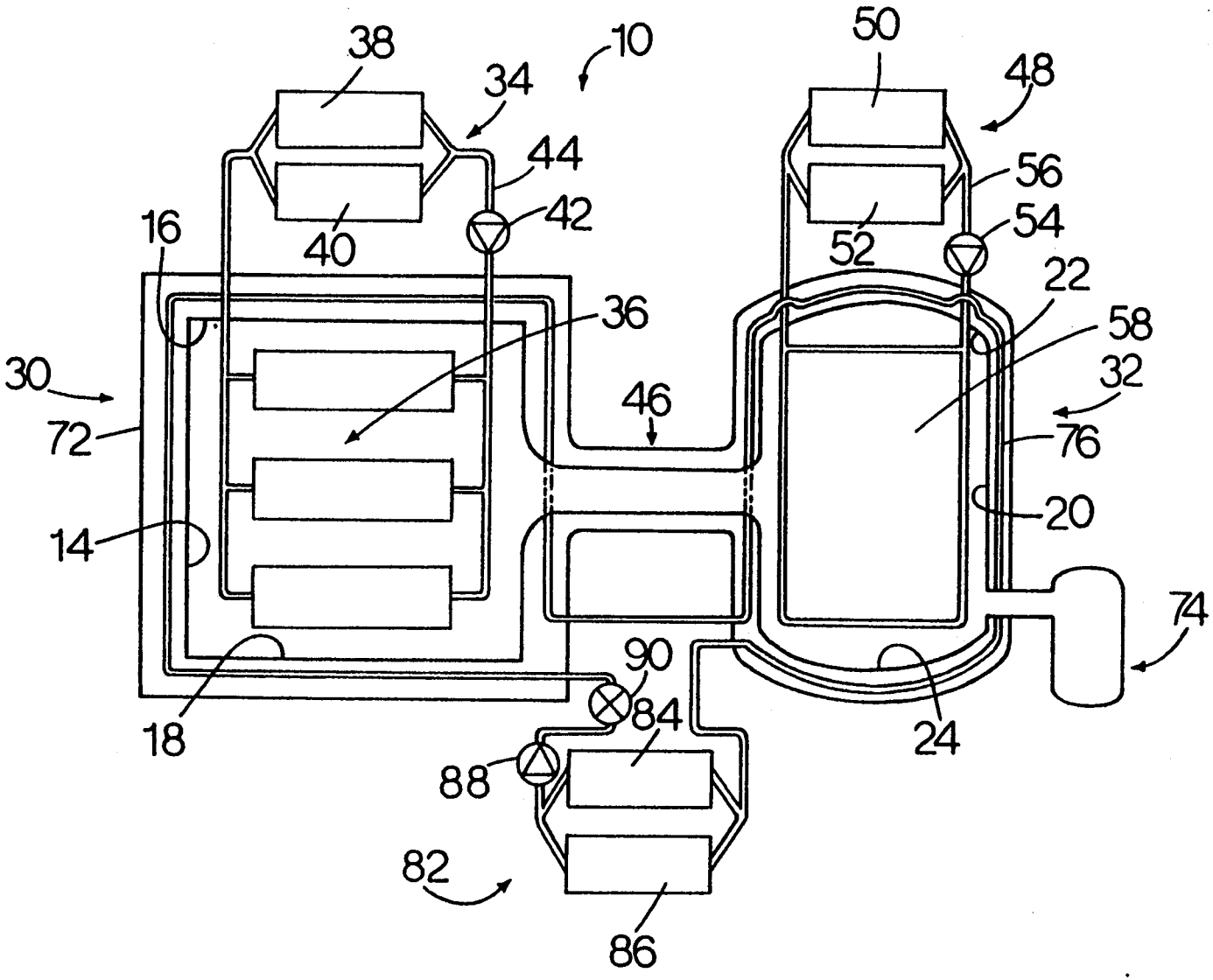
FIG. 2 is a schematic of the desiccation chamber of the present invention showing an autonomous circulation system surrounding the walls of both the desiccation chamber and the trap chamber of the present invention.

Once the desiccated material 12 has been removed from the desiccation chamber 30, hydrogen peroxide or a similar sterilization material is added to both the desiccation chamber 30 and trap chamber 32 (FIGS. 1 and 6). The apparatus 10 is then sealed and the apparatus 10 is heated using the rack temperature regulating circuit 34, the trap temperature regulating circuit 48, and the desiccation wall temperature regulating circuit 62. In alternative embodiments of the present invention shown in FIGS. 2–4 the trap chamber 32 is provided with heat-carrying fluid circulating tubes 76–80 connected to a heating source such as an apparatus wall temperature regulating circuit 82 (FIG. 2). By heating the trap 58, the racks 36, and the walls 14–24 of both the desiccation chamber 30 and the trap chamber 32 at the same time, to the same temperature, the sterilization of the apparatus 10 may be accompolished more accurately, and therefore within a shorter period of time.

Figure 7:
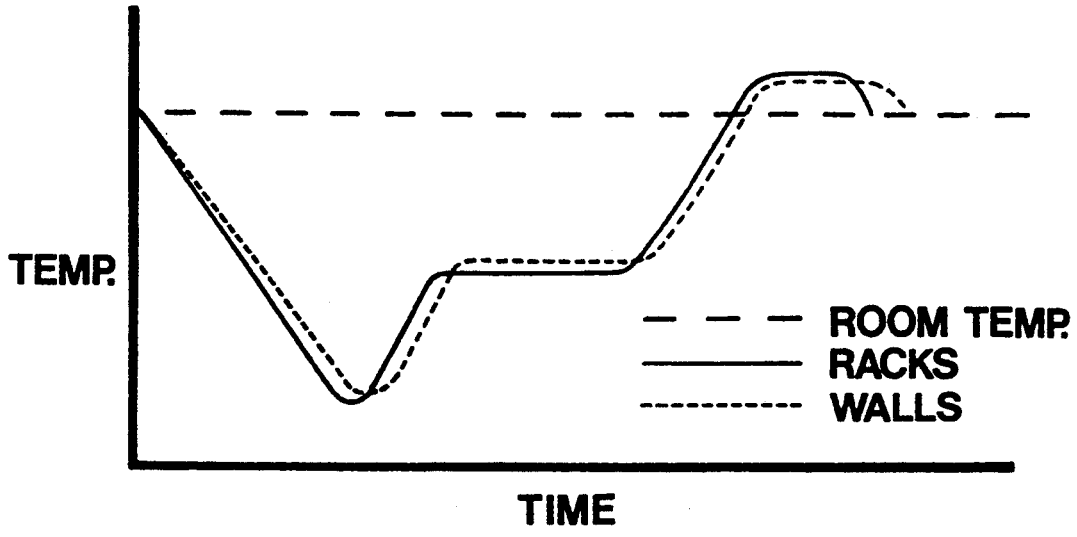
FIG. 7 is a graphic representation of the temperatures of the racks and walls of the desiccation chamber throughout the desiccation process.

A particular advantage of the present invention over the prior art is the accuracy attainable with the process and apparatus 10. FIG. 7 graphically shows the relative temperatures of the racks and walls of a typical desiccation apparatus during the desiccation process. As can be see by the dashed line, the walls of the typical apparatus tend to remain closer to room temperature than do the racks, regardless of whether the racks are being cooled or heated. Additionally, there is a discernible delay in temperature flux between the racks and the walls (FIG. 7). This delay is caused by the length of time required for the heat generated by or carried away by the racks to move toward or from the walls. Because the temperature of the walls 14–18 of the desiccation chamber 30 are not regulated in prior art devices, the temperature of this heating and cooling delay causes a temperature gradient between material 78 placed at the center of the racks 36 and material 80 placed along the edges of the racks 36 (FIG. 6).

Due to the radiation of heat from the walls of a typical desiccation apparatus toward the interior of the apparatus, material closer to these walls cools down more slowly and remains at a higher temperature than material further from the walls. Similarly, when the racks of a typical desiccation apparatus are heated above the temperature of the walls, the walls act as a heat sink drawing heat away from the racks and away from material placed near the edges of the racks. Material at the edges of the racks therefore tends to remain at a cooler temperature than material placed near the center of the racks.

These temperature gradients in prior art apparatuses lead to inconsistent desiccation between material placed near the edges of racks and material placed near the center of racks. This inconsistency often leads to a lengthened desiccation process in an effort to assure that all the material, even the material at the sides of the racks, has been properly desiccated. Furthermore, for very sensitive materials, such as pharmaceuticals, the temperature gradient between the material at the edges of the racks and material at the center of the racks may even lead to the product being destroyed or unusable for human consumption.

Figure 8:
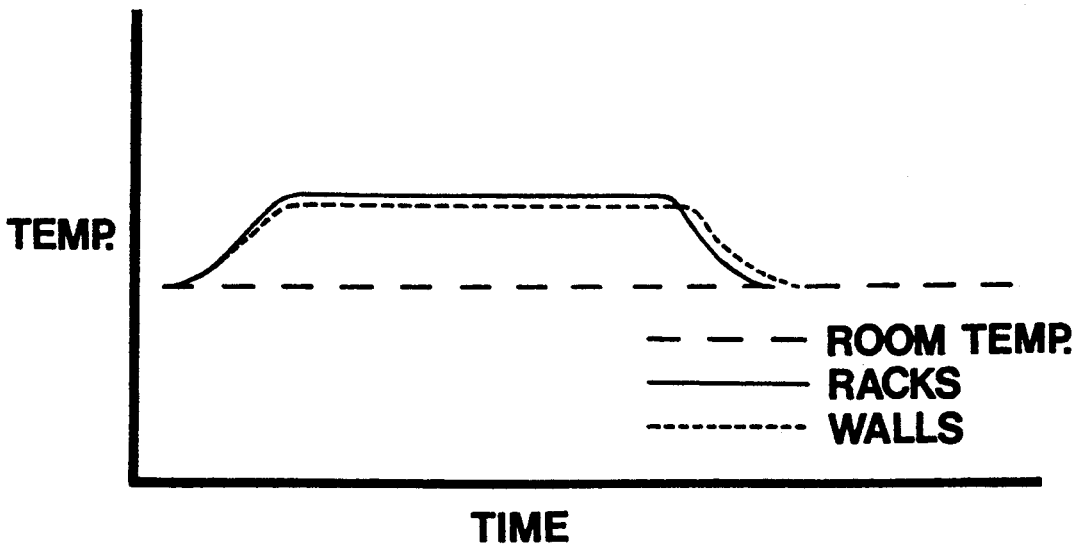
FIG. 8 is a graphic representation of the temperatures of the racks and walls of the desiccation chamber throughout the sterilization process.

Similarly, during sterilization of prior art desiccation apparatuses, the sterilization material often has a narrow range of temperatures within which its sterilization properties are most effective. Accordingly, a temperature gradient between the walls of the chamber and the interior of the chamber means that it is likely that at least a portion of the chamber remains outside this optimal range of temperatures during the sterilization process. This often leads to incomplete or unsuccessful sterilization. As shown geographically in FIG. 8, while it is possible to bring the racks to the proper sterilization temperature for the appropriate amount of time, the walls of prior art chambers often experience a delay in heating and remain somewhat below the temperatures of the racks during the sterilization process. This temperature gradient between the racks and the walls makes consistent sterilization in prior art devices extremely difficult.

Figure 3:
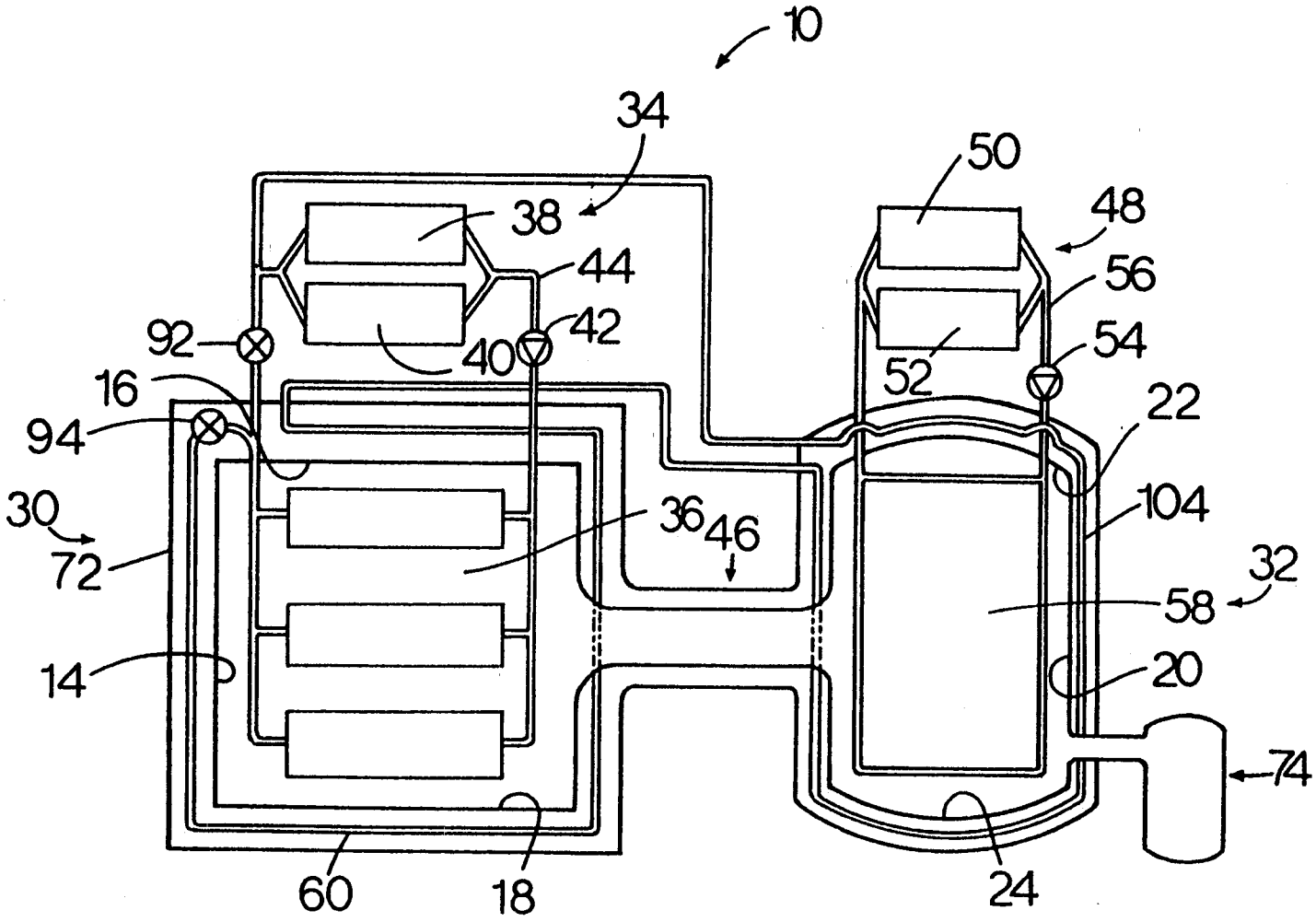
FIG. 3 is a schematic of the present invention showing the rack circulation system also encompassing the walls of the desiccation chamber and trap chamber of the present invention.

By heating the walls of the desiccation chamber during both the desiccation and sterilization procedures, the present invention produces a more consistent product and allows easier sterilization of the apparatus 10 (FIG. 1). The present invention may also be adapted to regulate the temperature of the walls 20–24 of the trap chamber 32 during desiccation and sterilization. As shown in FIG. 2, the apparatus wall temperature regulating circuit 82 is provided with a heat production unit 84, a cold production unit 86, and a fluid circulation pump 88 connected to the heat-carrying fluid circulating tube 76 surrounding the desiccation chamber 30 and the trap chamber 32. Alternatively, as shown in FIG. 3, the rack temperature regulating circuit 34 may be connected in series to the heat-carrying fluid circulating tubes 60 which surround the walls 14–18 of the desiccation chamber 30 and to the heat-carrying fluid circulating tubes 78 surrounding the walls 20–24 of the trap chamber 32.

Figure 4:
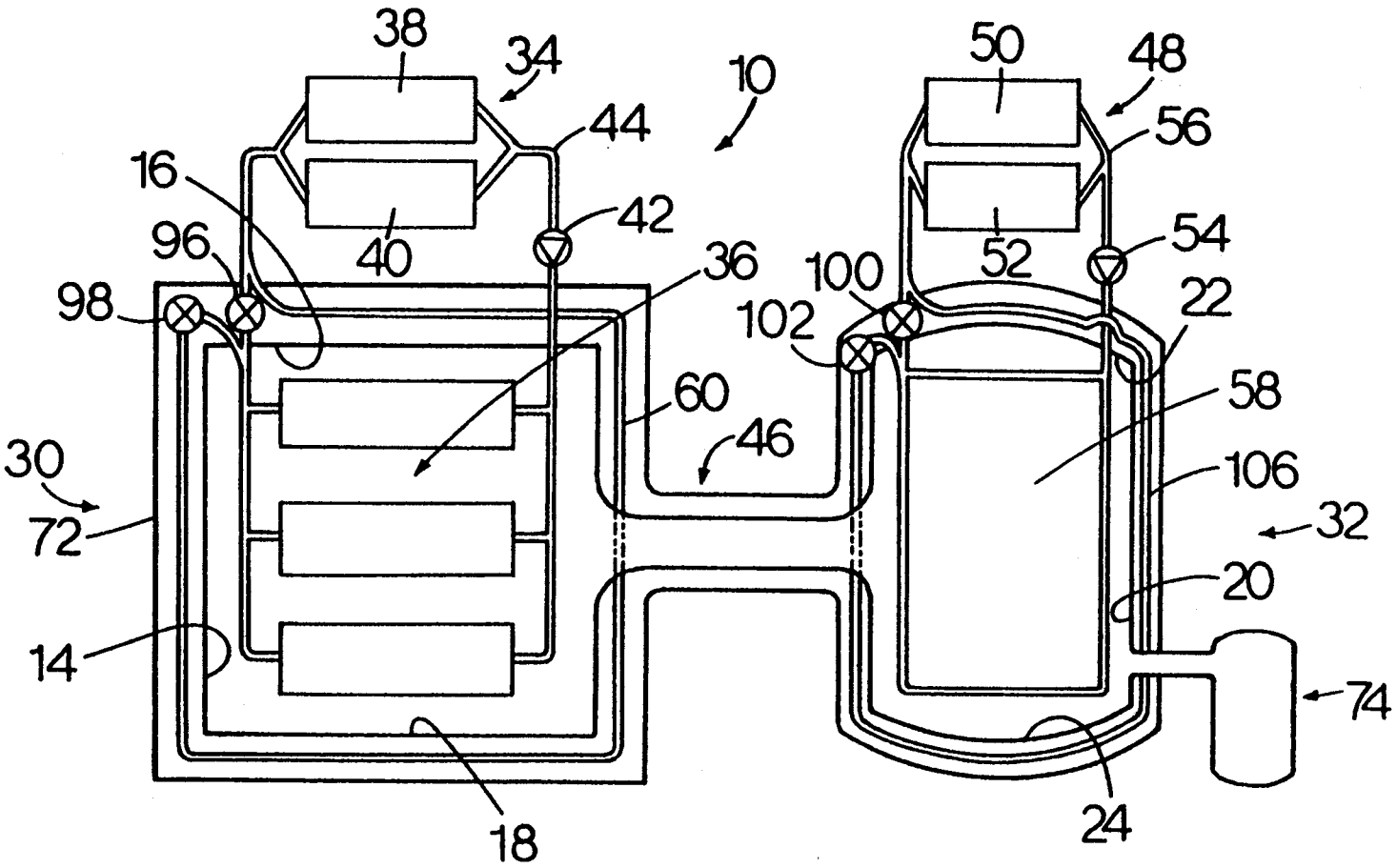
FIG. 4 is a schematic of the present invention showing the rack circulation system also encompassing the walls of the desiccation chamber, and the trap circulation system also encompassing the walls of the trap chamber of the present invention.

In another alternative embodiment, shown in FIG. 4, the heat-carrying fluid circulating tubes 60 surrounding the desiccation chamber 30 may be connected to the heat-carrying fluid circulating tubes 44 delivering heat to the racks 36 while the heat-carrying fluid circulating tubes 80 surrounding the walls 20–24 of the trap chamber 32 may be connected to the heat-carrying circulating tubes 56 regulating the temperature of the trap 58. All of these alternative embodiments are provided with shut-off valves 90–102 which allows the heat-carrying fluid circulating tubes 60 and 76–80 to be by-passed when heating of the walls 14–24 is not required.

The foregoing descriptions and drawings merely explain and illustrate the invention and the invention is not limited thereto, except insofar as the claims are so limited, as those skilled in the art who have the disclosure before them will be able to make modifications and variations therein without departing from the scope of the invention. By way of example, although fluid carrying tubes are particularly well adapted for heating and cooling the walls 14–24 of the apparatus, various well-known temperature regulating means may be used to heat and cool the walls 14–24.

What is claimed is:

1. A desiccation apparatus for removing water from material comprising:

a. a desiccation chamber having walls;

b. means operably provided within said desiccation chamber for supporting the material;

c. a trap chamber having walls;

d. means operably connecting said desiccation chamber to said trap chamber for allowing passage of water vapor from said desiccation chamber to said trap chamber;

e. a trap operably provided within said trap chamber;

f. means operably connected to said supporting means for regulating the temperature of said supporting means;

g. means operably connected to said trap for regulating the temperature of said trap; and h. means operably connected to said walls of said desiccation chamber for regulating the temperature of said walls of said desiccation chamber.

2. The desiccation apparatus of claim 1, wherein said desiccation wall temperature regulating means are a primary set of heat-carrying fluid circulating tubes traversing said walls of said desiccation chamber.

3. The desiccation apparatus of claim 2, wherein said supporting means temperature regulating means are a secondary set of heat-carrying fluid circulating tubes traversing said supporting means and operably connected to said primary set of heat-carrying fluid circulating tubes.

4. The desiccation apparatus of claim 3, wherein said secondary set of heat-carrying fluid circulating tubes is operably connected to said primary set of heat-carrying fluid circulating tubes at a point where said second set of heat-carrying fluid circulating tubes exits said desiccation chamber.

5. The desiccation apparatus of claim 3, further comprising a valve operably connected to said primary set of heat-carrying fluid circulating tubes and being of a construction which allows the valve to stem the flow of fluid from said secondary set of heat-carrying fluid circulating tubes into said primary set of heat-carrying fluid circulating tubes.

6. The desiccation apparatus of claim 3, further comprising means operably connected to said walls of said trap chamber for regulating the temperature of said walls of said trap chamber.

7. The desiccation apparatus of claim 6, wherein said trap chamber wall temperature regulating means are a tertiary set of heat-carrying fluid circulating tubes traversing said walls of said trap chamber.

8. The desiccation apparatus of claim 7, wherein said trap temperature regulating means are a quaternary set of heat-carrying fluid circulating tubes traversing said trap and operably connected to said tertiary set of heat-carrying fluid circulating tubes.

9. The desiccation apparatus of claim 7, wherein said tertiary set of heat-carrying fluid circulating tubes are operably connected to said primary set of heat-carrying fluid circulating tubes.

10. The desiccation apparatus of claim 1, further comprising a heat-carrying liquid provided within said desiccation chamber wall temperature regulating means, wherein said liquid is a silicone refrigerating liquid which is capable of being brought to a temperature of at least 122° C. while still remaining at a pressure of around 1,000 pascals.

11. A desiccation apparatus for removing water from material comprising:

a. a desiccation chamber having walls;

b. a rack operably provided within said desiccation chamber, in supporting relationship of the material;

c. a trap chamber having walls;

d. means operably connecting said desiccation chamber to said trap chamber for allowing passage of water vapor from said desiccation chamber to said trap chamber;

e. a trap operably provided within said said trap chamber;

f. a primary set of heat-carrying fluid circulating tubes operably connected to said walls of said desiccation chamber;

g. a secondary set of heat-carrying fluid circulating tubes operably connected to said rack;

h. a tertiary set of heat-carrying fluid circulating tubes operably connected to said walls of said trap chamber;

i. a quaternary set of heat-carrying fluid circulating tubes operably connected to said trap;

j. means operably connecting said primary set of heat-carrying fluid circulating tubes to said secondary set of heat-carrying fluid circulating tubes in a manner which allows said rack to be maintained at substantially the same temperature as said walls of said desiccation chamber; and k. means operably connecting said tertiary set of heat-carrying fluid circulating tubes to said quaternary set of heat-carrying fluid circulating tubes in a manner which allows said trap to be maintained at substantially the same temperature as said walls of said trap chamber.

12. A method for desiccating a material comprising:

a. operably connecting a desiccation chamber having walls and a rack, to a trap chamber having walls and a trap, in a manner which allows passage of water vapor from said desiccation chamber to said trap chamber;

cooling said rack to a predetermined temperature; and cooling said walls of said desiccation chamber by pumping a heat-carrying fluid through set of heat-carrying fluid circulating tubes traversing said walls of said desiccation chamber.

13. The desiccating method of claim 12, wherein said heat-carrying fluid is a silicone refrigerating liquid which is capable of being brought to a temperature of at least 122° C. while still remaining at a pressure of around 1,000 pascals.

14. A method for desiccating a material comprising:

a. operably connecting a desiccation chamber having walls and a rack, to a trap chamber having walls and a trap, in a manner which allows passage of water vapor from said desiccation chamber to said trap chamber;

b. heating said rack to a predetermined temperature; and c. heating said walls of said desiccation chamber by pumping a first heat-carrying fluid through a primary set of heat-carrying fluid circulating tubes traversing said walls of said desiccation chamber.

15. The desiccating method of claim 14, further comprising heating said walls of said trap chamber by pumping a second heat-carrying fluid through a secondary set of heat-carrying fluid circulating tubes traversing said walls of said trap chamber.

16. The desiccating method of claim 15, further comprising sterilizing said desiccation chamber, said rack, said trap chamber, and said trap by adding hydrogen peroxide to said desiccation chamber and said trap chamber.

* * * * *